US006575382B1

(12) United States Patent
Fischer et al.

(10) Patent No.: US 6,575,382 B1
(45) Date of Patent: Jun. 10, 2003

(54) FUEL INJECTION WITH AIR BLASTED SHEETED SPRAY

(75) Inventors: Thomas Huntington Fischer, Rochester, NY (US); Paul G. VanBrocklin, Rochester, NY (US); Gail E. Geiger, Caledonia, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/394,495

(22) Filed: Sep. 13, 1999

(51) Int. Cl.[7] ..... F02D 1/06; F02M 61/00

(52) U.S. Cl. ..... 239/5; 239/403; 239/408; 239/418; 239/427; 239/434; 239/524; 239/533.2; 239/533.12

(58) Field of Search ..... 123/531, 585; 239/5, 8, 404, 405–406, 409, 410, 407, 408, 411, 418, 414, 415, 426, 431, 433, 434, 432, 533.1, 533.2, 533.12, 518, 524

(56) References Cited

U.S. PATENT DOCUMENTS

| | | | | | |
|---|---|---|---|---|---|
| 3,385,527 | A | * | 5/1968 | Drewry | 239/418 |
| 4,515,129 | A | | 5/1985 | Stettner | 123/472 |
| 4,572,436 | A | | 2/1986 | Stettner et al. | 239/585 |
| 4,655,395 | A | * | 4/1987 | Cioffi et al. | 239/427 |
| 4,982,716 | A | * | 1/1991 | Takeda et al. | 123/531 |
| 5,035,358 | A | * | 7/1991 | Katsuno et al. | 239/403 |
| 5,070,845 | A | | 12/1991 | Avdenko et al. | 123/470 |
| 5,540,387 | A | * | 7/1996 | Reiter et al. | 239/408 |
| 5,711,281 | A | | 1/1998 | Lorraine | 239/409 |
| 6,065,691 | A | * | 5/2000 | West | 239/407 |

* cited by examiner

*Primary Examiner*—Steven J. Ganey
(74) *Attorney, Agent, or Firm*—Patrick M. Griffin

(57) ABSTRACT

A fuel injector is provided which includes a director, such as a ball, mounted downstream of the fuel injection port. When the valve is actuated, fuel exits the injection port. Fuel adheres to the ball until it reaches the equator of the ball. At the equator, the fuel begins to separate from the ball and forms a sheeted, cone-shaped configuration. When used with poppet valve injectors, the present invention preferably includes a wall manifold above the ball. Air from an air source, such as from the engine vacuum is introduced through the wall. Air travels through an air distribution chamber at a ninety degree angle to the direction of fuel flow. The air stream is directed to the ball's equator. This blast of air causes the fuel to atomize to a droplet size in the range of 3 to 6 microns SMD. When the invention is used with solenoid actuated fuel injectors, a ball is mounted downstream of the director plate. In this case, an air housing carries air from an air source to an air blast chamber. The air blast chamber directs air at a ninety degree angle to the sheeted fuel. The air is directed to the equator of the ball. Instead of using a ball, directors of other shapes could be used such as ground balls of various shapes and truncated cones.

20 Claims, 3 Drawing Sheets

FUEL INJECTION WITH AIR BLASTED SHEETED SPRAY

TECHNICAL FIELD

This invention relates to a fuel injector for an internal combustion engine. More particularly, this invention relates to an improved method and apparatus for atomizing the fuel expelled from a fuel injector.

BACKGROUND OF THE INVENTION

Various types of fuel injectors are used in the fuel injection systems of internal combustion engines. One type of injector uses a solenoid armature located between the pole piece of the solenoid and a fixed valve seat to operate the valve member. Examples of such electromagnetic fuel injectors or solenoid controlled valve structures are described in U.S. Pat. Nos. 4,515,129 issued May 7, 1985 to Stettner and 4,572,436 issued Feb. 25, 1986 to Stettner et al., the disclosures of which are hereby incorporated by reference. The above identified patents show arrangements in which an armature/valve is biased to a normally closed position against a fixed valve seat by a spring member. The armature/valve is operable between a seated, sealing position against the valve seat and an open position against a pole piece of the solenoid for controlling fuel flow through a fuel injector port in the valve seat.

Another type of fuel injector, referred to as a poppet valve injector, uses a solenoid to open a valve which exposes the poppet to a high pressure blast of fuel. When the pressure differential across the valve member reaches a desired level, the valve member is displaced from a valve seat and the nozzle discharges fuel to an engine inlet port. One poppet type injector is described in U.S. Pat. No. 5,070,845 issued to Avdenko et al. the disclosure of which is hereby incorporated by reference.

With either type of fuel injector, it is desirable to have complete combustion of the fuel injected into the engine cylinder to increase the fuel efficiency of the engine and to decrease undesirable emissions. The more finely the fuel is atomized, i.e. the smaller the fuel droplets, the more complete the combustion. The typical atomization with current fuel injectors yields droplets of between 30 and 100 microns Sauter mean diameter (SMD), when the engine is cold. It is desirable to reduce the droplet size to ensure that complete combustion occurs when cold starting an engine. The present invention uses a blast of air to increase the atomization, i.e. to decrease the droplet size.

U.S. Pat. No. 5,711,281 issued to Lorraine discloses the use of air to assist in the atomization of fuel. However, in the Lorraine reference, the fuel is expelled from the injector in a stream and the air is used to atomize this stream of fuel. In a fuel injector which uses a poppet valve or director member mounted to a director plate, the fuel exits the injector after passing over the poppet valve or director member. When this occurs, the detachment of fuel causes the fuel to form an "onion skin" pattern which is very unstable in the presence of air. This fuel condition is referred to as sheeted fuel. A fuel injector is needed which reduces the fuel droplet size in a sheeted spray of fuel which has been atomized by a director or poppet valve.

In fuel injectors which use directors or poppet valves, such injectors were designed in such a way to avoid placing surfaces downstream of the injection port to prevent the accumulation of fuel on those surfaces. The accumulation of fuel on surfaces downstream of the injection port dramatically affects combustion of the fuel. A fuel injector is needed which increases the atomization of fuel without allowing fuel to accumulate on surfaces downstream of the injection port.

SUMMARY OF THE INVENTION

The fuel injector of the present invention includes a director, such as a ball or other director member, mounted downstream of the fuel injection port. When the valve is actuated, fuel passes over the ball. The fuel adheres to the ball until it reaches the equator of the ball. At the equator, the fuel begins to separate from the ball and forms a sheeted, cone-shaped configuration. Typically this cone has sides which are 15 degrees from vertical.

When used with poppet valve injectors, the present invention preferably includes an air distribution manifold above the valve ball. Air from an air source, such as from the engine air intake manifold is introduced into the distribution manifold. The distribution manifold includes ports for introducing air into the air distribution chamber. Air travels through the air distribution chamber at preferably a ninety degree angle to the direction of fuel flow, although other angles will work. The air stream is directed just below the ball's equator. We have found that air at 300 kPa flowing at 102 standard liters per minute achieves excellent atomization. This blast of air causes the sheeted fuel to atomize to a droplet size in the range of 3 to 6 microns SMD. The opening below the ball is on the order of 0.1 inches and has side walls which are forty-five degrees from vertical. The thickness of the air distribution chamber is on the order of 0.01 inches. With these dimensions, we have found that the pressure drop across the lower opening is sufficient to prevent the accumulation of fuel on the surfaces below the poppet valve ball.

When the invention is used with solenoid actuated fuel injectors, a director plate is mounted downstream of the valve and valve seat. A ball, or other director member, is mounted to the director plate on the downstream side of the director plate. An air housing carries air from an air source to an air blast chamber. The air blast chamber directs air at preferably a ninety degree angle to the sheeted fuel. The air is directed just below the equator of the ball. The blast of air causes the sheeted fuel to atomize more finely. Instead of using a ball, directors of other shapes could be used such as ground balls of various shapes and truncated cones.

These and other objects and features of the invention will become apparent by reference to the following description and to the drawings.

DESCRIPTION OF THE PREFERRED EMBODIMENT

Figure 1:
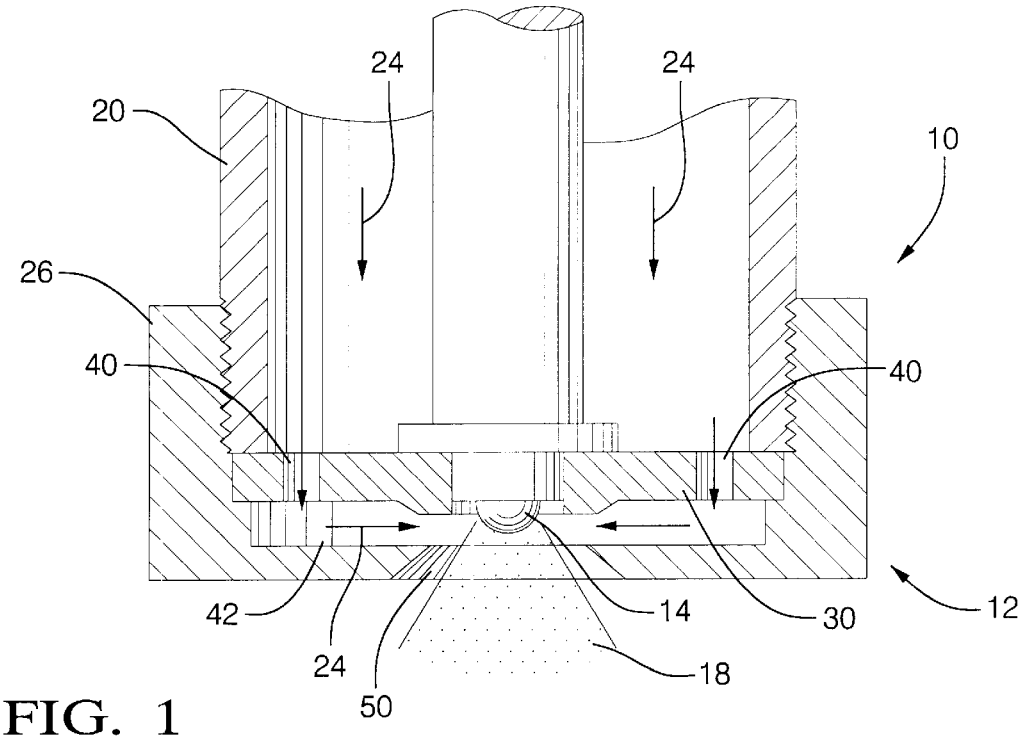
FIG. 1 is a cross-sectional view of a poppet nozzle including the present invention.
Figure 2:
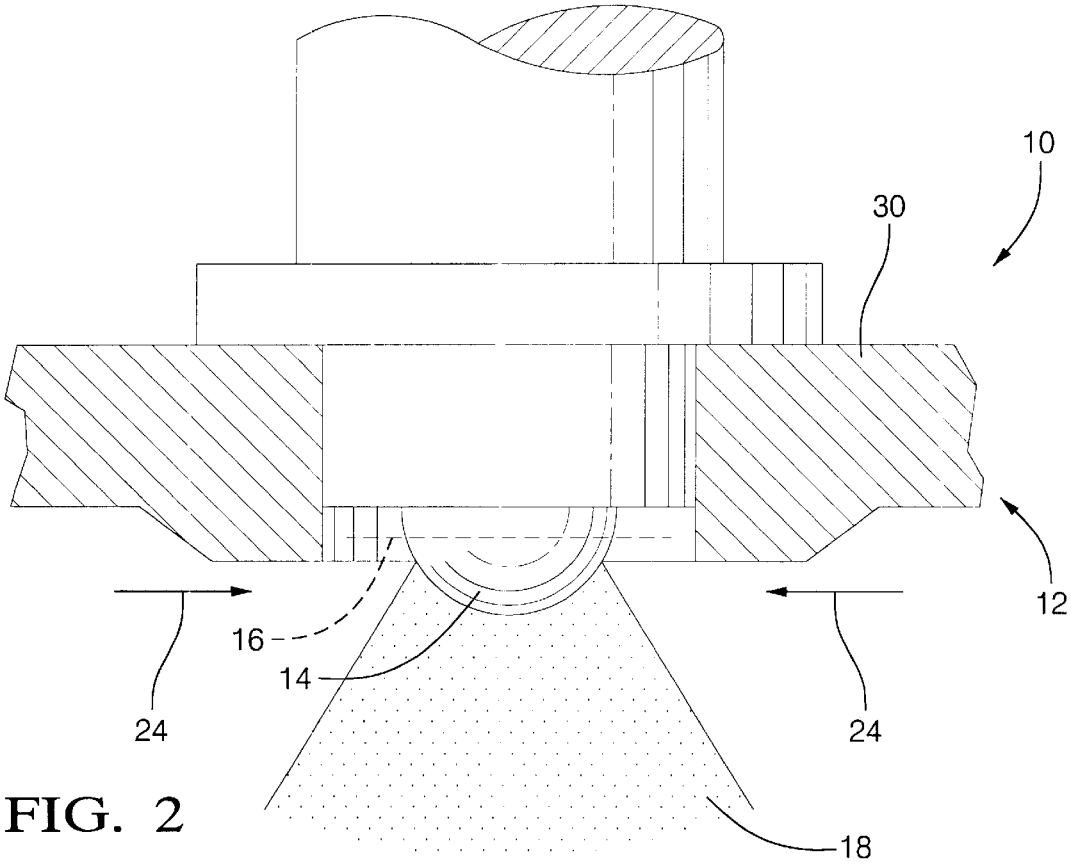
FIG. 2 is an enlarged cross-sectional view of the poppet nozzle of FIG. 1.
Figure 3:
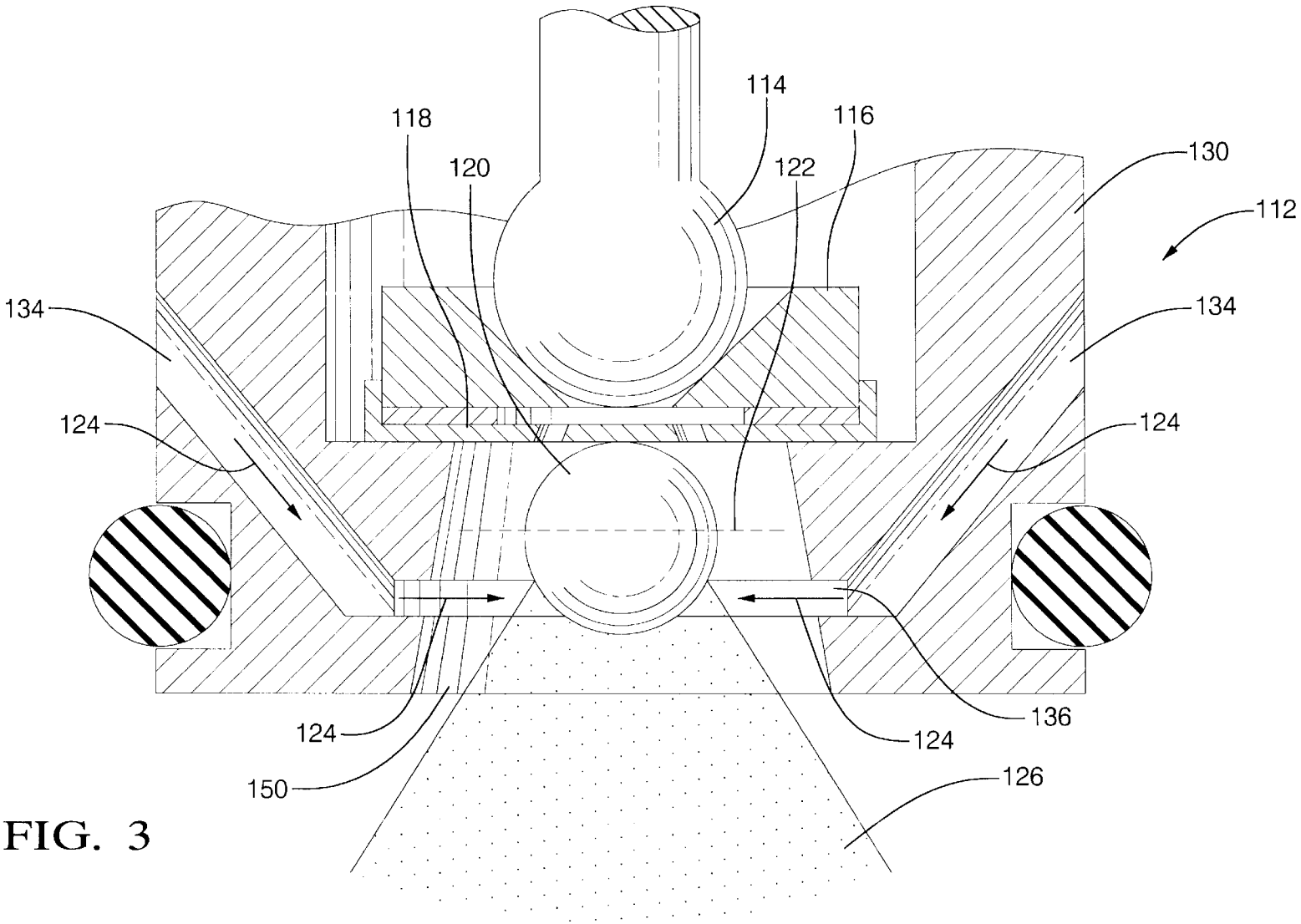
FIG. 3 is a cross-sectional view of a solenoid actuated fuel injector including the present invention.

In FIGS. 1–3 there is illustrated a nozzle 10 of a fuel injection system useful to deliver finely atomized fuel to a cylinder of an internal combustion engine (not shown). Referring to FIGS. 1 and 2, a poppet nozzle injector 12 is shown. The poppet nozzle 12 is disposed within an air tube 20. A ball shaped valve 14 is attached to the lower end of the poppet nozzle 12.

The air tube 20 is provided to carry a supply of air, represented by arrows 24, from the engine air intake manifold (not shown). An assembly nut 26 surrounds the air tube 20 and holds the air tube 20 in place. A lower wall 30 forms the bottom of the air tube 20. The lower wall 30 includes a plurality of ports 40 for directing air into an air blast chamber 42. When the poppet valve 12 is actuated, fuel 18 flows around the valve ball 14 and begins to separate from the ball at the ball's equator 16, which is the circumference of the ball at a horizontal plane through the ball 14. The separated fuel 18 forms a sheeted, is conical pattern, as is known. Typically, the surface of the cone is at 15 degrees from the vertical. Without the air blast of the present invention, the cone is formed of fuel droplets which are on the order of 30 to 100 microns SMD. The air 24 flowing through the air blast chamber 42 is directed at a ninety degree angle toward the valve 14. The air 24 contacts the flowing fuel just below the ball's equator 16. The air blast causes the sheeted fuel to become more finely atomized to a droplet size of 3 to 6 microns SMD. The fuel then exits the fuel injection port 50.

Referring to FIG. 3, a solenoid actuated fuel injector 112 is shown. The fuel injector 112 includes a valve 114 which rests in a valve seat 116. Below the valve seat 116 is a director plate 118. A ball 120 is mounted to the director plate 118. An air housing 130 surrounds the valve seat 116 and ball 120. The air housing 130 includes a plurality of air passages 134 adapted to deliver air 124 to an air blast chamber 136. The air blast chamber 136 is adapted to carry air 124 at a ninety degree angle to the flow of fuel 126. Fuel 126 flowing around the ball 120 begins to separate from the ball 120 at the ball's equator 122 and forms a sheeted, cone shaped pattern. The air 124 contacts the fuel 126 just below the ball's equator 122 and causes the fuel to atomize more finely. The atomized fuel 126 exits through the injection port 150.

Figure 4A:
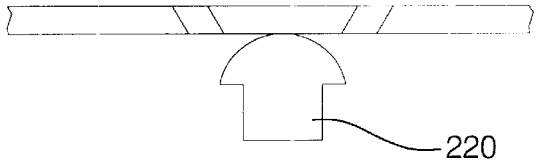
FIG. 4*a* is an illustration of a director in the shape of a mushroom.
Figure 4B:
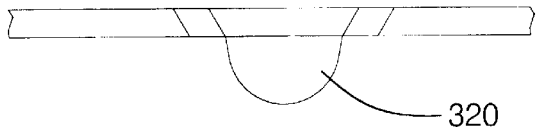
FIG. 4*b* is an illustration of a director in the shape of a hemisphere with the flat surface attached to the director plate.
Figure 4C:
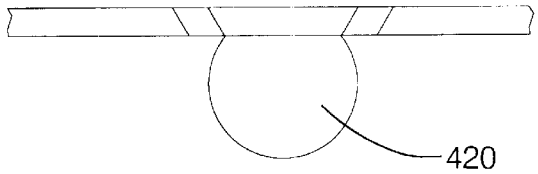
FIG. 4*c* is an illustration of a director in the shape of a truncated sphere with the flat portion of the truncated sphere attached to the director plate.
Figure 4D:
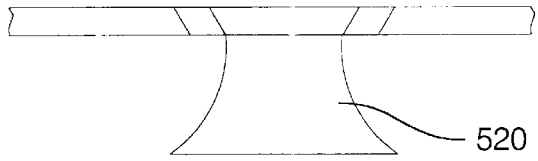
FIG. 4*d* is an illustration of a director in the shape of a truncated bell mouth.
Figure 4E:
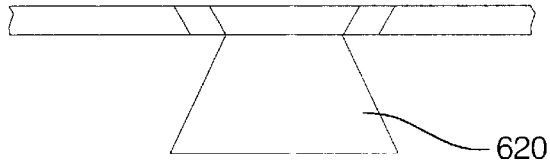
FIG. 4*e* is an illustration of a director in the shape of a truncated cone.

The ball 120 could be replaced with the directors shown in FIGS. 4*a*–4*e*. FIG. 4*a* illustrates a director 220 in the shape of a mushroom. FIG. 4*b* illustrates a director 320 in the shape of a hemisphere. FIG. 4*c* illustrates a director 420 in the shape of a sphere with the top portion ground flat. FIG. 4*d* illustrates a director 520 in the shape of a truncated bell mouth. FIG. 4*e* illustrates a director 620 in the shape of a truncated cone. Those of ordinary skill in the art will recognize that other shapes of directors will work with the principles of the present invention.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A method of atomizing fuel exiting a fuel injector nozzle comprising the steps of: passing the fuel over a director member, wherein said director member is in the shape of a truncated sphere with a flat portion attached to a director plate, causing the fuel to leave the director member in a form of a sheeted spray; and directing a stream of air toward the sheeted spray of fuel to atomize the fuel.

2. The method of claim 1 wherein the step of directing the stream of air includes directing the stream of air at an angle of approximately ninety degrees to the direction of flow of the fuel.

3. An apparatus for atomizing fuel to be injected into a combustion chamber of an internal combustion engine comprising:

an air tube in communication with a supply of pressurized air;

a wall disposed at one end of the air tube;

an air chamber disposed below the wall, the wall having a plurality of ports in communication with said air chamber to deliver air from the air tube to the air chamber;

a valve extending into the air chamber, said valve having means for forming an atomized spray of fuel, said air chamber disposed adjacent said sheeted spray of fuel to deliver air toward the fuel spray to further atomize the fuel.

4. The apparatus of claim 3 wherein the air is delivered toward the atomized fuel at an angle of approximately 90 degrees to the direction of flow of the atomized fuel.

5. An apparatus for atomizing fuel to be injected into a combustion chamber of an internal combustion engine comprising:

a valve and a valve seat;

an air housing surrounding the valve seat in communication with a supply of pressurized air and having air passages therethrough;

a director plate disposed below the valve seat;

a director member attached to the director plate, the director member having means for forming a sheeted spray of fuel and to atomize the fuel passing over the director member;

an air chamber disposed below the director plate to thereby deliver air from the air passages toward the director member to further atomize the fuel; and an injection port for delivering the atomized fuel to the combustion chamber.

6. The apparatus of claim 5 wherein the air is delivered toward the atomized fuel at an angle of approximately 90 degrees to the direction of flow of the atomized fuel.

7. The apparatus of claim 5 wherein the director member is in the shape of a sphere.

8. The apparatus of claim 5 wherein the director member is in the shape of a hemisphere.

9. The apparatus of claim 5 wherein the director member is in the shape of a truncated sphere with a flat portion attached to the director plate.

10. The apparatus of claim 5 wherein the director member is in the shape of a truncated bell mouth.

11. The apparatus of claim 5 wherein the director member is in the shape of a truncated cone.

12. The apparatus of claim 5 wherein the director member is in the shape of a mushroom.

13. An apparatus for atomizing fuel to be injected into a combustion chamber of an internal combustion engine comprising:

a valve and a valve seat;

an air housing surrounding the valve seat in communication with a supply of pressurized air and having air passages therethrough;

a director plate disposed below the valve seat;

a director member attached to the director plate, the director member having means for forming a sheeted spray of fuel and to atomize the fuel passing over the director member; and an air chamber disposed below the director plate to thereby deliver air from the air passages toward the director member to further atomize the fuel.

14. The apparatus of claim 13 wherein the air is delivered at an angle of approximately 90 degrees to the direction of flow of the atomized fuel.

15. The apparatus of claim 13 wherein the director member is in the shape of a sphere.

16. The apparatus of claim 13 wherein the director member is in the shape of a hemisphere.

17. The apparatus of claim 13 wherein the director member is in the shape of a truncated sphere with a flat portion attached to the director plate.

18. The apparatus of claim 13 wherein the director member is in the shape of a truncated bell mouth.

19. The apparatus of claim 13 wherein the director member is in the shape of a truncated cone.

20. The apparatus of claim 13 wherein the director member is in the shape of a mushroom.

* * * * *